US008226268B2

(12) United States Patent
Tsai

(10) Patent No.: US 8,226,268 B2
(45) Date of Patent: Jul. 24, 2012

(54) WATERTIGHT ROPE LIGHT

(76) Inventor: Chwei-Jei Tsai, Taichung (TW)

( * ) Notice: Subject to any disclaimer, the term of this patent is extended or adjusted under 35 U.S.C. 154(b) by 365 days.

(21) Appl. No.: 12/650,523

(22) Filed: Dec. 30, 2009

(65) Prior Publication Data

US 2011/0019403 A1 Jan. 27, 2011

(30) Foreign Application Priority Data

Jul. 21, 2009 (TW) ..... 98213307 U

(51) Int. Cl.
*F21S 13/14* (2006.01)
*F21V 1/00* (2006.01)

(52) U.S. Cl. ..... 362/249.06; 362/244; 362/249.02; 362/249.03; 362/249.04; 362/391

(58) Field of Classification Search ..... 362/244, 362/249.02–249.19, 391
See application file for complete search history.

(56) References Cited

U.S. PATENT DOCUMENTS

| | | | | |
|---|---|---|---|---|
| 5,404,282 | A * | 4/1995 | Klinke et al. | 362/249.06 |
| 6,406,166 | B1 * | 6/2002 | Ko | 362/249.03 |
| 6,604,841 | B2 * | 8/2003 | Liu | 362/235 |
| 7,152,999 | B2 * | 12/2006 | Lin | 362/249.06 |
| 2004/0201988 | A1 * | 10/2004 | Allen | 362/249 |

* cited by examiner

*Primary Examiner* — Stephen F Husar
*Assistant Examiner* — James Cranson, Jr.

(57) ABSTRACT

A watertight rope light of the present invention includes two parallel wires, a plurality of light emitting diodes and a transparent enclosing layer. The light emitting diodes are substantially parallel to the wires. Each light emitting diode has a semiconductor die, a lens, an anode leg and a cathode leg. The lens has a distal end, which is formed with an awl-shaped concave surface, and the semiconductor die is adapted to emit light toward the concave surface. As such, the light emitted from the semiconductor die can be reflected radially outward to illuminate the surrounding uniformly.

7 Claims, 4 Drawing Sheets

WATERTIGHT ROPE LIGHT

BACKGROUND OF THE INVENTION

1. Field of the Invention

The present invention relates to a watertight rope light.

2. Description of the Prior Art

A conventional watertight rope light as disclosed in U.S. Pat. No. 6,394,623 utilizes a translucent sheath to encase conducting strings and a plurality of lights, such as light emitting diodes.

However, the light emitting diodes are difficult to use in applications requiring a spherical light field due to its lambertian distributing nature. As such, the light emitting diodes of '623 are disposed slanted to the lengthy direction of the rope light so as to provide better illumination performance. However, such design would lead to a disadvantage that only the head sides of the light emitting diodes can be illuminated, while the leg sides thereof are still shadowed.

Besides, the lights of '623 are connected with each other in series. As such, the whole set of lights goes out of function when one of the lights is dead.

The present invention is, therefore, arisen to obviate or at least mitigate the above mentioned disadvantages.

SUMMARY OF THE INVENTION

The main object of the present invention is to provide a watertight rope with uniform illumination performance.

To achieve the above and other objects, the rope light of the present invention includes at least one elongated rope light element, each of which includes two parallel wires, a plurality of light emitting diodes and a transparent first enclosing layer. The light emitting diodes are spaced disposed along the wires, and an orientation of the light emitting diodes is substantially parallel to the wires. Each light emitting diode has a semiconductor die, a lens, an anode leg and a cathode leg. The anode leg connects the semiconductor die with one of the wires, and the cathode leg connects the semiconductor die with the other one of the wires. The lens encloses the semiconductor die, and it has a distal end away from the semiconductor die. The distal end of the lens is formed with an awl-shaped concave surface. The semiconductor die is adapted to emit light toward the concave surface. As such, the light can be reflected radially outward to illuminate the surrounding uniformly.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
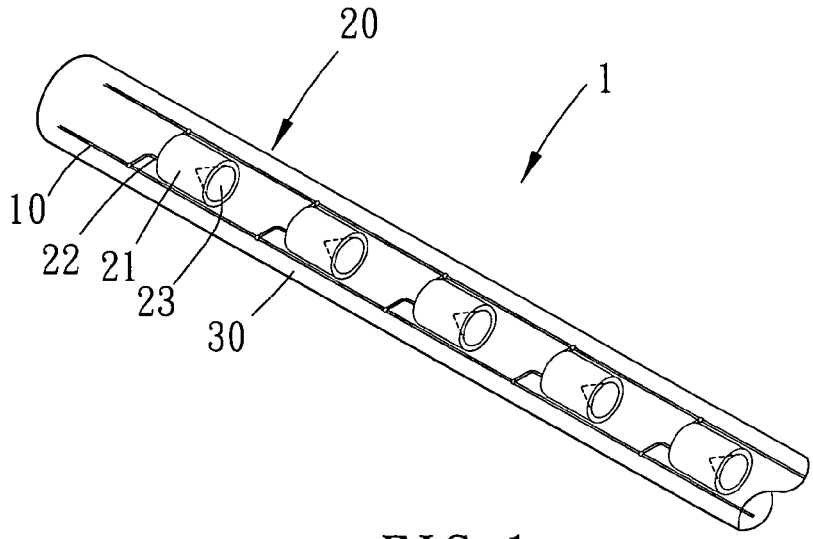
FIG. 1 is a partial perspective view showing a rope light of the present invention.
Figure 2:
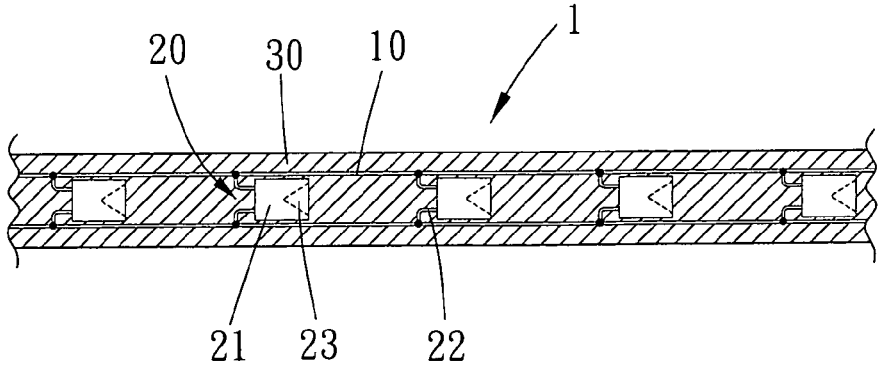
FIG. 2 is a profile showing a rope light of the present invention.

Please refer to FIG. 1 and FIG. 2 for a first embodiment of the present invention. The watertight rope light of the present embodiment is substantially constituted by a single elongated rope light element 1, which includes two parallel wires 10, a plurality of light emitting diodes 20 and a first enclosing layer 30. The wires 10 are made of conducting material such as copper metal. The light emitting diodes 20 are spaced disposed along the wires 10, and an orientation of the light emitting diodes 20 is substantially parallel to the wires 10. Preferably, the light emitting diodes 20 are arranged head-to-heel with each other.

Each light emitting diode 20 has a semiconductor die (not shown), a lens 21 and two legs 22 including an anode leg and a cathode leg, in which the anode leg connects the semiconductor die with one of the wires, and the cathode leg communicating the semiconductor die with the other wire. In the preset embodiment, the legs 22 joint the wires in a welding manner. The lens 21 encloses the semiconductor die and has a distal end away from the semiconductor die. The distal end is formed with an awl-shaped concave surface 23. Because the lens 21 in the preset embodiment is substantially cylindrical, the concave surface 23 is correspondingly formed into a concave conical shape. Preferably, an axis of the concave surface 23 is parallel to that of the elongated rope light element 1. The semiconductor die is adapted to emit light toward the concave surface 23, and a part of the light will be reflected by the concave surface 23 and emit radially outward. Thus the rope light of the present invention can perform better side illumination.

The first enclosing layer 30 is transparent or translucent and is made of plastic to solidly enclose the wires 10 and the light emitting diodes 20 in a manner of injection molding. As such, water is isolated outside the first enclosing layer 30 and will not cause short circuiting problems. In addition, the first enclosing layer 30 is preferably made of flexible PVC material so that the rope light can be bent, twisted or coiled as desired.

Figure 3:
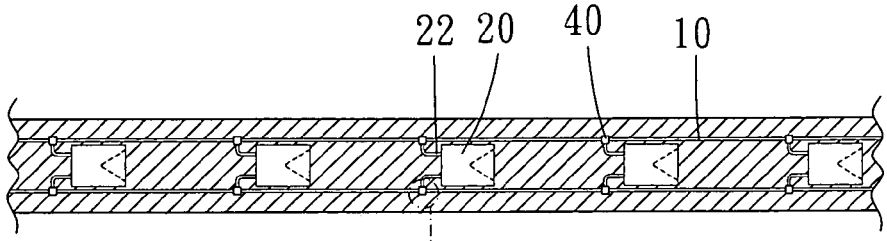
FIG. 3 is a profile showing another rope light of the present invention.
Figure 3A:
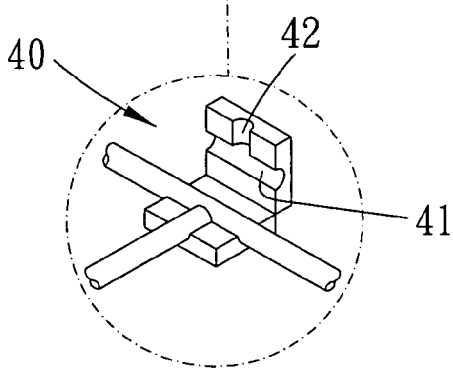
FIG. 3A is a perspective view showing an adapter of the present invention.
Figure 3B:
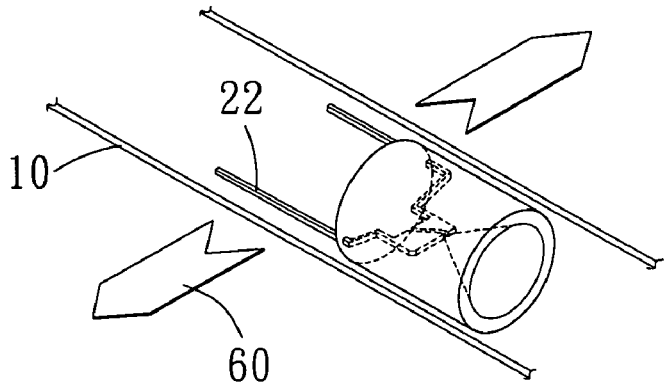
FIG. 3B is a perspective view showing two metal plates disposed between legs and wires.
Figure 3C:
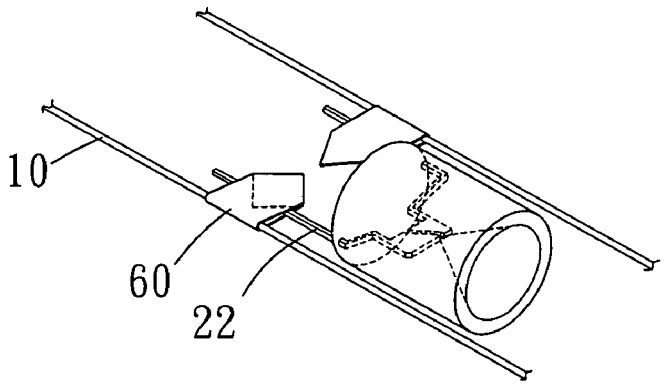
FIG. 3C is a perspective view showing two metal plates sandwiching legs and wires.

Please refer to FIG. 3 and FIG. 3A for the second embodiment of the present invention. A plurality of adapters 40 are disposed between each leg 22 and its corresponding wire 10 respectively. Each adapter 40 has a wire groove 41 and a leg groove 42. The wire groove 41 has two open ends, and the leg groove 42 has an open end and a connecting end communicating with the wire groove 41. As such, the wire groove 41 is adapted to receive a part of one of the wires 10, and the leg groove 42 is adapted to receive a part of one of the legs 22 so as to electrically connect the leg 22 with the wire 10. It is to be noted that the welding connection between the leg and the wire is sometimes fragile and is easily broken during injection molding process or when the rope light is seriously bent or twisted. On the other hand, such mechanical connecting manner by means of adapters can further ensure the firm electrical connection between the leg and the wire. Or, as shown in FIG. 3B and FIG. 3C, the mechanical connecting manner can be achieved by metal plates 60, each sandwiching one of the legs 22 and its corresponding wire 10. The metal plate 60 may be designed to have a pointed arrow-shaped end and a V-shaped notch end corresponding to the arrow-shaped end. Once the metal plate 60 is folded to sandwich the leg and the wire, the arrow-shaped end can be further folded to piece the V-shaped notch. As such, the electrical connection between the leg and the wire can be firmly established.

Figure 4:
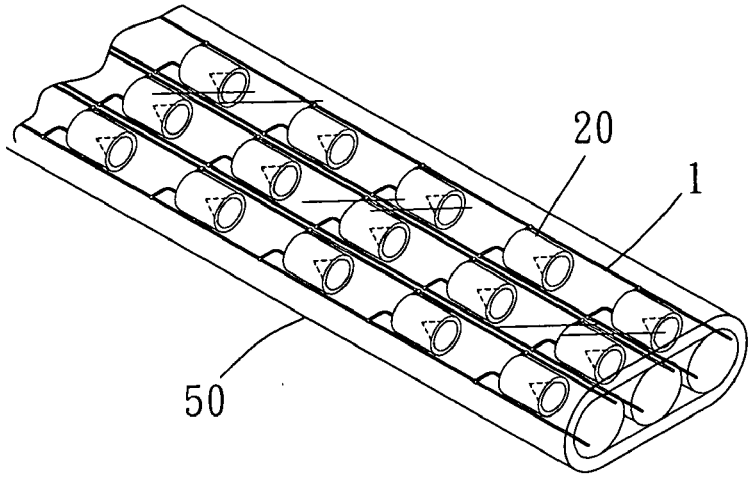
FIG. 4 is a perspective view showing yet another rope light of the present invention.
Figure 5:
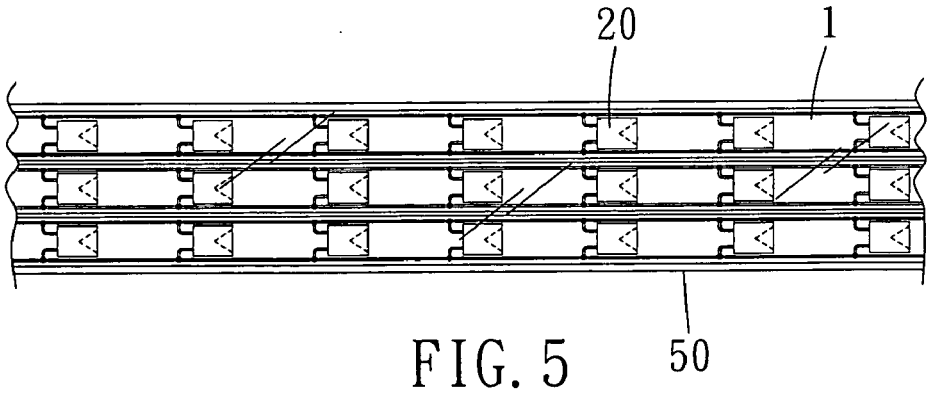
FIG. 5 is a top view showing yet another rope light of the present invention.

Please refer to FIG. 4 and FIG. 5 for the third embodiment of the present invention. The rope light in the present embodiment consists of three elongated rope light elements 1. The number of which is variable as a matter of choice. The rope light elements 1 are parallelly arranged and enclosed by a second enclosing layer 50. The second enclosing layer 50 may also be made of PVC material to perform abilities of watertight and flexibility. In addition, the rope light may have light emitting diodes that can emit light of different colors respectively. Furthermore, the light emitting diodes may be arranged in rows or in an alternative manner to provide different visual performance.

It is to be noted that the legs of a light emitting diode connect with different wires. That is, the light emitting diodes of the present invention is electrically connected with each other in parallel. As a result, the rope light of the present invention can still function even when one or some light emitting diodes go dead. Thus it would be a more economic solution for the users who want to use rope lights repeatedly.

What is claimed is:

1. A watertight rope light, having at least two elongated rope light elements, each of which comprising:

two parallel wires;

a plurality of light emitting diodes, spaced disposed along the wires, an orientation of the light emitting diodes being substantially parallel to the wires, each of the light emitting diodes having a semiconductor die, a lens, an anode leg and a cathode leg, the anode leg connecting the semiconductor die with one of the wires, the cathode leg connecting the semiconductor die with the other one of the wires, the lens enclosing the semiconductor die, the lens having a distal end away from the semiconductor die, the distal end of the lens being formed with an awl-shaped concave surface, the semiconductor die being adapted to emit light toward the concave surface;

a transparent first enclosing layer, solidly enclosing the wires and the light emitting diodes.

2. The rope light of claim 1, wherein a plurality of adapters are disposed between each leg and its corresponding wire respectively, each adapter has a wire groove and a leg groove, the wire groove has two open ends, the leg groove has an open end and a connecting end communicating with the wire groove, the wire groove is adapted to receive a part of one of the wires, the leg groove is adapted to receive a part of one of the legs so as to electrically connect the leg with the wire.

3. The rope light of claim 1, wherein a plurality of metal plates are disposed between each leg and its corresponding wire respectively, each metal plate is adapted to sandwich one of the legs and its corresponding wire so as to electronically connect the leg with the wire.

4. The rope light of claim 1, wherein the elongated rope light elements are parallelly arranged, a transparent second enclosing layer encloses the elongated rope light elements together.

5. The rope light of claim 1, wherein an axis of each awl-shaped concave surface is parallel to that of its corresponding elongated rope light element.

6. The rope light of claim 3, wherein each metal plate has an arrow-shaped end and a V-shaped notch end.

7. A watertight rope light, comprising:

two parallel wires;

a plurality of light emitting diodes, spaced disposed along the wires, an orientation of the light emitting diodes being substantially parallel to the wires, each of the light emitting diodes having a semiconductor die, a lens, an anode leg and a cathode leg, the anode leg connecting the semiconductor die with one of the wires, the cathode leg connecting the semiconductor die with the other one of the wires, the lens enclosing the semiconductor die, the lens having a distal end away from the semiconductor die, the distal end of the lens being formed with an awl-shaped concave surface, the semiconductor die being adapted to emit light toward the concave surface;

a transparent enclosing layer, solidly enclosing the wires and the light emitting diodes.

* * * * *